US009556724B2

(12) United States Patent
Spesivtsev et al.

(10) Patent No.: US 9,556,724 B2
(45) Date of Patent: Jan. 31, 2017

(54) METHOD FOR DETERMINING PARAMETERS OF A BOTTOMHOLE AND A NEAR-BOTTOMHOLE ZONE OF A WELLBORE

(71) Applicant: SCHLUMBERGER TECHNOLOGY CORPORATION, Sugar Land, TX (US)

(72) Inventors: Pavel Evegenievich Spesivtsev, Moscow (RU); Valery Vasilievich Shako, Domodedovo (RU); Bertrand Theuveny, Moscow (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 340 days.

(21) Appl. No.: 14/109,664

(22) Filed: Dec. 17, 2013

(65) Prior Publication Data

US 2014/0174729 A1 Jun. 26, 2014

(30) Foreign Application Priority Data

Dec. 24, 2012 (RU) ..... 2012155806

(51) Int. Cl.
*E21B 47/06* (2012.01)
*E21B 49/00* (2006.01)

(52) U.S. Cl.
CPC ..... *E21B 47/06* (2013.01); *E21B 49/00* (2013.01)

(58) Field of Classification Search
CPC ..... E21B 47/06; E21B 47/00; E21B 49/00
See application file for complete search history.

(56) References Cited

U.S. PATENT DOCUMENTS 4,123,937 A * 11/1978 Alexander ..... E21B 47/0003 73/152.31
4,415,028 A * 11/1983 Watkins ..... E21B 33/1294 166/206
4,799,157 A 1/1989 Kucuk et al.
5,249,461 A * 10/1993 Ponder ..... E21B 43/116 166/250.01
5,337,821 A 8/1994 Peterson
5,799,732 A * 9/1998 Gonzalez ..... E21B 43/116 166/177.5
5,896,926 A * 4/1999 Hama ..... E02D 1/06 166/250.07
6,325,146 B1 * 12/2001 Ringgenberg ..... E21B 21/002 166/186
7,675,287 B2 3/2010 Minh
2002/0017386 A1 * 2/2002 Ringgenberg ..... E21B 21/002 166/250.17
2010/0236777 A1 * 9/2010 Partouche ..... E21B 41/0085 166/254.2
2011/0087471 A1 4/2011 Postl et al.
2011/0088903 A1 * 4/2011 Onadeko ..... E21B 17/06 166/301

(Continued)

*Primary Examiner* — Jennifer H Gay

(57) ABSTRACT

Whiles moving a pipe string in a wellbore during tripping operations, pressure and temperature are measured. Based on the measured pressure and temperature, such parameters of a bottomhole and a near-bottomhole zone of the wellbore are calculated as skin factor, permeability, reservoir thickness, bottomhole pressure, and outflow or inflow from/to the zone under consideration.

12 Claims, 6 Drawing Sheets

(56) References Cited

U.S. PATENT DOCUMENTS

| | | | | |
|---|---|---|---|---|
| 2011/0130966 | A1* | 6/2011 | Zhan | E21B 49/087 702/12 |
| 2012/0000650 | A1* | 1/2012 | James | E21B 33/13 166/250.14 |
| 2012/0152542 | A1* | 6/2012 | Le | E21B 43/11 166/297 |
| 2012/0279292 | A1* | 11/2012 | Simonian | E21B 47/06 73/152.51 |
| 2014/0174729 | A1* | 6/2014 | Spesivtsev | |
| 2014/0210633 | A1* | 7/2014 | Hrametz | E21B 47/12 340/854.4 |
| 2015/0233239 | A1* | 8/2015 | Wang | E21B 49/008 166/252.5 |

* cited by examiner

METHOD FOR DETERMINING PARAMETERS OF A BOTTOMHOLE AND A NEAR-BOTTOMHOLE ZONE OF A WELLBORE

CROSS-REFERENCE TO RELATED APPLICATION

This application claims priority to Russian Application No. RU2012155806 filed Dec. 24, 2012, which is incorporated herein by reference in its entirety.

FIELD OF THE INVENTION

The invention relates to the field of completion and testing of wells in the oil and gas industry and is intended for estimation of parameters of a bottomhole and a near-bottomhole zone of a wellbore such as, for example, skin factor, permeability, reservoir thickness, bottomhole pressure, and outflow out of and/or inflow into the zone under consideration.

BACKGROUND OF THE INVENTION

In the prior art, various methods for determining parameters of a bottomhole and a near-bottomhole zone are known. In particular, the U.S. Pat. No. 4,799,157 describes a method for determining permeability and skin factor of two layers of a single reservoir. The method consists in performing two consecutive drill-hole hydrodynamic tests by means of creating a drawdown at the bottomhole with swapping of the production logging tool and subsequent interpretation of production rate and pressure data.

U.S. Pat. No. 5,337,821 shows a method for calculating formation fluid transmissibility as well as a method and metering apparatus for measuring production rates, open flow potential of the well, and for determining the dependency of near-bottomhole formation damage versus production rate. Measurements are conducted after deployment of the tool to a preset depth and isolation of intervals with the use of inflatable elastomer packers.

U.S. Pat. No. 7,675,287 describes a method for estimation of skin factor of a subsurface reservoir inside a wellbore by means of deployment of a measuring apparatus to a preset depth and measuring nuclear magnetic resonance of the formation at multiple depths.

US Patent Application No. 2011/0087471 proposes to establish a functional relationship between properties of the reservoir, characteristics of the near-bottomhole zone/completion of the well, and the measurable characteristics of the well. Confirmed values of reservoir properties, for example, permeability; characteristics of the near-wellbore zone/completion, for example, skin factor, are determined provided that the functional relationship is established.

The common drawback of the patents and patent applications is that all of them require special equipment or special downhole operations for determining properties of the bottomhole and the near-bottomhole zone. The distinction of the present invention is that information usually available in the course of well tests or well operation is used for determining properties of the bottomhole and the near-bottomhole zone. In other words, no non-standard equipment or additional operations are required for determining the parameters.

SUMMARY OF THE INVENTION

The invention provides a possibility of determining parameters of a bottomhole and a near-bottomhole zone such as a bottomhole pressure, during tripping operations with subsequent calculation of fluid inflow/outflow at the bottomhole, and calculation of a skin factor, permeability or a reservoir thickness. Realization of the proposed method can be achieved with the use of conventional pressure gauges that are widely used in the petroleum industry, without deployment of special tools into a well.

In accordance with the proposed method, pressure and temperature are measured in the process of moving a pipe string within a wellbore. Parameters of a bottomhole and a near-bottomhole zone are estimated based on results of the measurements.

The parameters of the bottomhole and the near-bottomhole zone may include a flowing bottomhole pressure, dynamics of fluid loss into a reservoir, dynamics of fluid inflow from a reservoir, total fluid loss or fluid inflow volume, skin factor, reservoir permeability or thickness.

According to one embodiment of the disclosure, pressure and temperature are measured by at least one pressure and temperature gauge installed at any place of the pipe string.

According to another embodiment of the disclosure, pressure and temperature are measured by two pressure and temperature gauges, one gauge is installed above a packer and the other below the packer.

According to one more embodiments of the disclosure, pressure and temperature are measured by the pressure and temperature gauge installed in the pipe string so that at the end or running the pipe string into the wellbore to the required depth, the pressure and temperature gauge is disposed adjacent to the reservoir.

In accordance with another embodiment of the disclosure, pressure and temperature are measured by at least one pressure gauge and at least one temperature gauge installed at any place along the pipe string.

According to one more embodiment of the disclosure, pressure and temperature are measured by at least one pressure gauge and at least one temperature gauge installed in the pipe string at the end of running the pipe string into the wellbore to the required depth, the pressure gauge and the temperature gauge are disposed adjacent to the reservoir.

The pipe string may be equipped with any additional tools, for example, samplers.

In accordance with another embodiment of the disclosure, pressure and temperature are measured in the process of running the pipe string into the wellbore. Pressure and temperature measurements can be measured prior to perforating the interval.

In accordance with another embodiment of the disclosure, pressure and temperature are measured in the process of pulling the pipe string out of the wellbore. Pressure and temperature can be measured after perforating the interval.

In accordance with one more embodiment of the disclosure, pressure and temperature are measured both in the process of running the pipe string into the wellbore and in the process of pulling the pipe string out of the wellbore.

BRIEF DESCRIPTION OF THE DRAWINGS

The invention is explained by drawings where.

DETAILED DESCRIPTION OF THE PREFERRED EMBODIMENTS

Figure 1:
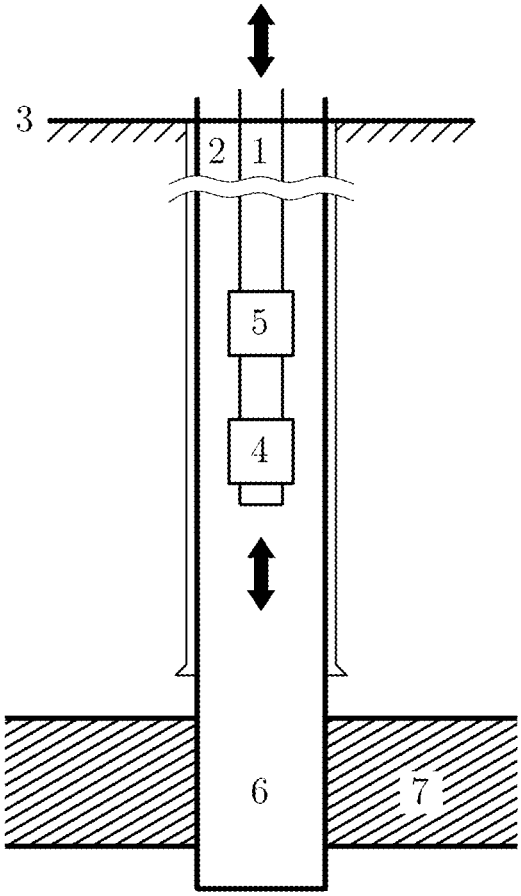
FIG. 1 shows a system for carrying out tripping operations and measurements.

As is shown in FIG. 1, a pipe string 1 or the pipe string 1 with additional tools is run into a wellbore 2 from a surface 3 for performance of certain operations. A gauge 4 for measuring pressure and temperature is installed in the pipe string 1. An additional gauge 5 or several additional gauges for measuring pressure and temperature may be installed in the system. The pipe string 1 is run into the wellbore 2 until it reaches a position 6 at a certain point in front of a subsurface reservoir 7 or adjacent to it. Pressure and temperature are recorded during the entire period the pipe string 1 is being run into the wellbore from the surface 3 to the position 6. After performing the running-in-hole operation, all planned downhole operations, and pulling the pipe string to the surface, the pressure and temperature gauges are retrieved to the surface with the measurements that were recorded during the tripping operations and the measurements recorded in the process of performance of the planned downhole operations.

Figure 6:
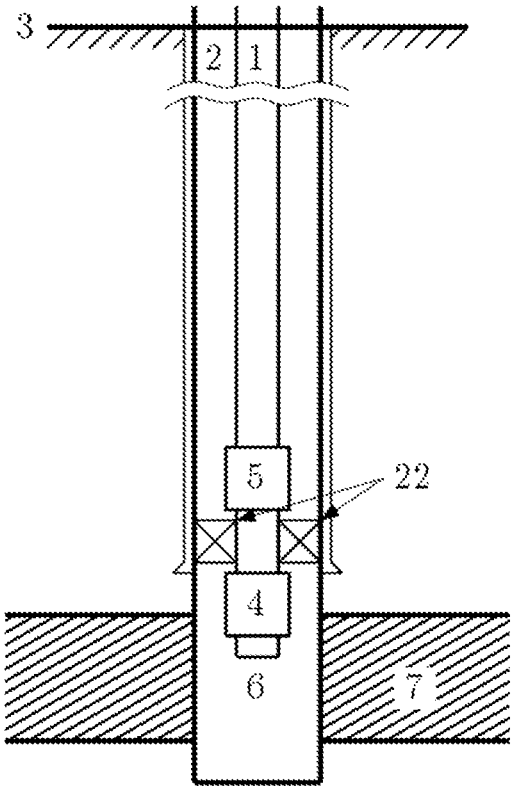
FIG. 6 shows an embodiment of the disclosure wherein one gauge pressure and temperature is installed above a packer and the other below the packer.

As it is shown on FIG. 6, in case of using two pressure and temperature gauges, one of the gauges may be installed above a packer 22 and the other below the packer 22. The arrangement with the two gauges makes it possible to determine density ρ proceeding from the pressure difference by readings of the two pressure gauges. Using the formula of hydrostatic pressure, we obtain:

$$\rho(t) = \frac{p_g(t)}{g l_g \cos\theta_g}$$

where g is gravity constant, $l_g$ is a distance between the two pressure gauges, and $\theta_g$ is a mean inclination angle of this part of the wellbore. Note that this formula is valid for slow processes in which frictional pressure losses play a less significant role than the hydrostatic pressure difference. Temperature measurements may be used for determining the relationship between properties of the fluid at the surface and at the point of measurement downhole.

Figure 2:
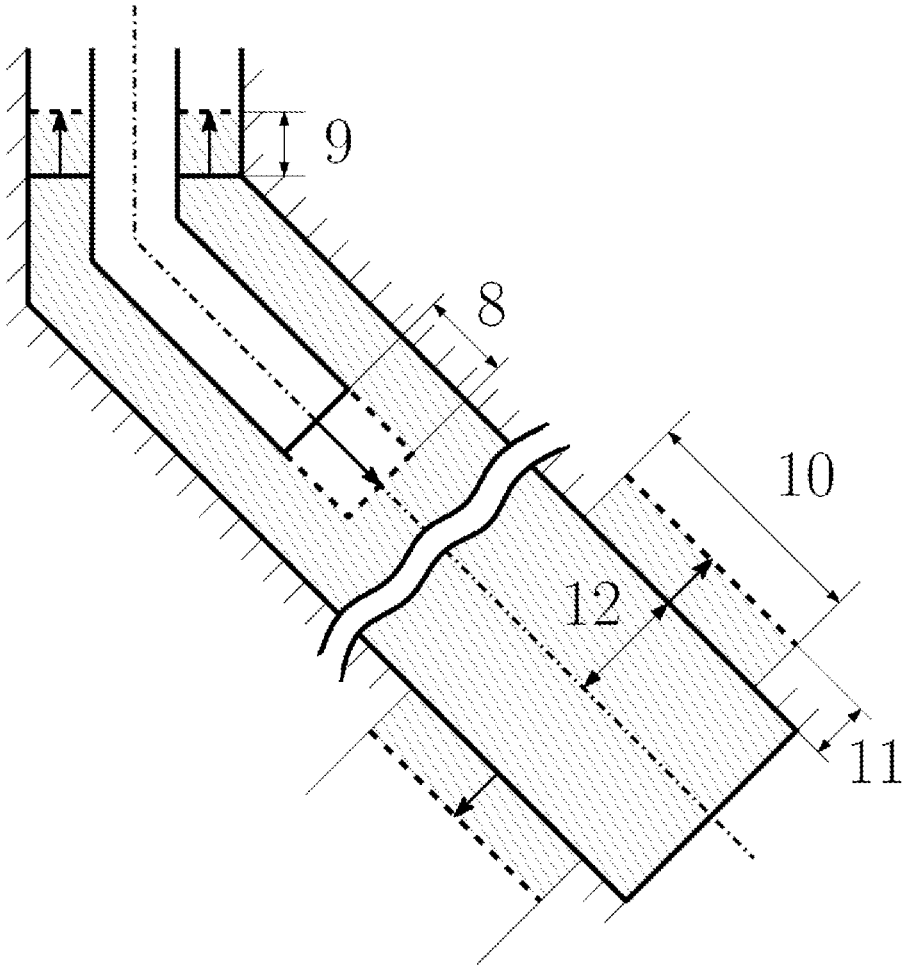
FIG. 2 shows a displacement process in a simplified geometrical form.

Let us consider volume balance during running the pipe string into the wellbore. For the sake of simplicity, we will neglect compressibility of fluids and assume that the level of liquid in the annulus rises strictly vertically while movement of the drill string or tubing string with the bottomhole arrangement for performance of formation (reservoir) testing takes place along a slant line (see FIG. 2).

The moving drill pipe string with the bottomhole arrangement for performance of formation (reservoir) testing displaces a certain volume of fluid $V_{DST}$ during a period of time t. At the same time, the fluid volume in an annulus increases by $V_{an}$ and volume $V_r$ is taken up by the reservoir. Hence, in this case we have $$V_{DST}=V_{an}+V_r \tag{1}$$

These volumes can be expressed simpler in the following form $$V_{DST}=A_{DST}z_{DST}$$

$$V_{an}=A_{an}Z_{an}$$

$$V_r=2\pi r_w r=Q_{loss}t$$

where $Z_{DST}$ is a measured depth of drill pipe string advance during time t (8 in FIG. 2), $z_{an}$ is a height of rise of a fluid column in the annulus during time t (9 in FIG. 2), $A_{an}$ is a cross sectional area available for flow in the annulus, $A_{DST}$ is a cross sectional area of the drill pipe string calculated at its outside diameter, is a difference between the measured depths of reservoir top and bottom (reservoir thickness, 10 in FIG. 2) or length of a perforated interval, r is a depth of wellbore fluid invasion into the reservoir (11 in FIG. 2), $r_w$ is a radius of the wellbore (12 in FIG. 2), $Q_{loss}$ is a volume rate of outflow from the wellbore to the reservoir.

Having substituted the last expression into Equation (1) and having divided by t, we obtain $$A_{DST}\frac{z_{DST}}{t} = A_{an}\frac{z_{an}}{t} + Q_{loss} \tag{2}$$

The term in the left-hand part of Equation (2) expresses the velocity of running the drill string with the bottomhole arrangement for performance of formation (reservoir) testing in the wellbore $$v_{DST}(t) = \frac{z_{DST}}{t}$$

The value of this velocity $v_{DST}$ is assumed as a set value. Usually this velocity is of the order of several centimeters per second. Let us consider now the first term in the right-hand part of Equation (2). The increment of fluid level in the annulus is proportional to the increasing hydrostatic bottomhole pressure which, for slow processes in a near-vertical wellbore equals chiefly the hydrostatic component $$\frac{z_{an}}{t} = \frac{1}{\rho g}\frac{p_{wf}}{t}$$

where $p_{wf}$ denotes the change in bottomhole pressure during time t.

Note that more complex geometrical characteristics and velocity intervals can be taken into consideration in the last expression. The second term in the right-hand part of the equation can be expressed, for example, from the steady-state relationship of fluid inflow in a development well (the relationship of flowing bottomhole pressure versus flow rate)

$$Q_{loss} = \frac{2\pi k}{\mu(\ln(r_e/r_w)+s)}(p_{wf}-p_e)$$

Here k is permeability, μ is viscosity, $r_e$ is equivalent radius of pressure, s is skin factor, $p_e$ is formation pressure determined at the equivalent radius of pressure.

Substituting the last tree equalities for Equation (2) with $t \to 0$, we obtain a simple ordinary differential equation of first order $$\frac{dp_{wf}}{dt} = \frac{\rho g}{A_{an}}(A_{DST}v_{DST}(t)\ PI(p_{wf}\ \ p_e)) \tag{3}$$

where PI is productivity index of the well.

$$PI = \frac{2\pi k}{\mu(\ln(r_e/r_w)+s)}$$

Equation (3) can be written in explicit discretized form.

$$p_{wf}^{n+1} = p_{wf}^{n} + t\frac{\rho g}{A_{an}}(A_{DST}v_{DST}^{n} - PI(p_{wf}^{n} - p_e)) \tag{4}$$

Equation (4) is easily solved numerically for calculating a hydrodynamic bottomhole pressure $p_{wf}$, which in turn makes it possible to calculate a volume flow rate of fluid uptake by the reservoir $Q_{loss}(t)$. Skin factor s is determined by matching the value satisfying the preset parameters, problem specifications, and satisfying requirements for the check-out parameters (see below). It is necessary to note that in this problem value of permeability k might become an unknown value (value to be determined). In this case it could be found with a preset skin factor s and reservoir thickness. On the other hand, reservoir thickness also might be unknown (value to be determined). In such case, it could be found with a preset skin factor s and permeability k.

Reliability of results predicted by the model can be checked through calculation of the following check-up parameters: location of the drill string with the bottomhole arrangement for performance of formation (reservoir) testing)

$$z_{DST}(t) = z_{DST}(0)\int_0^t v_{DST}(t)dt \tag{5}$$

Height of fluid level in the annulus $$z_{an}(t) = z_{an}(0) + \frac{p_{wf}(t) - p_e}{\rho g} \tag{6}$$

and pressure of the lower pressure gauge $$p_{gc}(t) = p_e \rho g z_{DST}(t)\cos\theta \tag{7}$$

It is necessary to pay attention to the fact that, for the sake of simplicity, values of both $z_{DST}(t)$ and $z_{an}(t)$ are measured along the wellbore, starting from the bottomhole.

Figure 3:
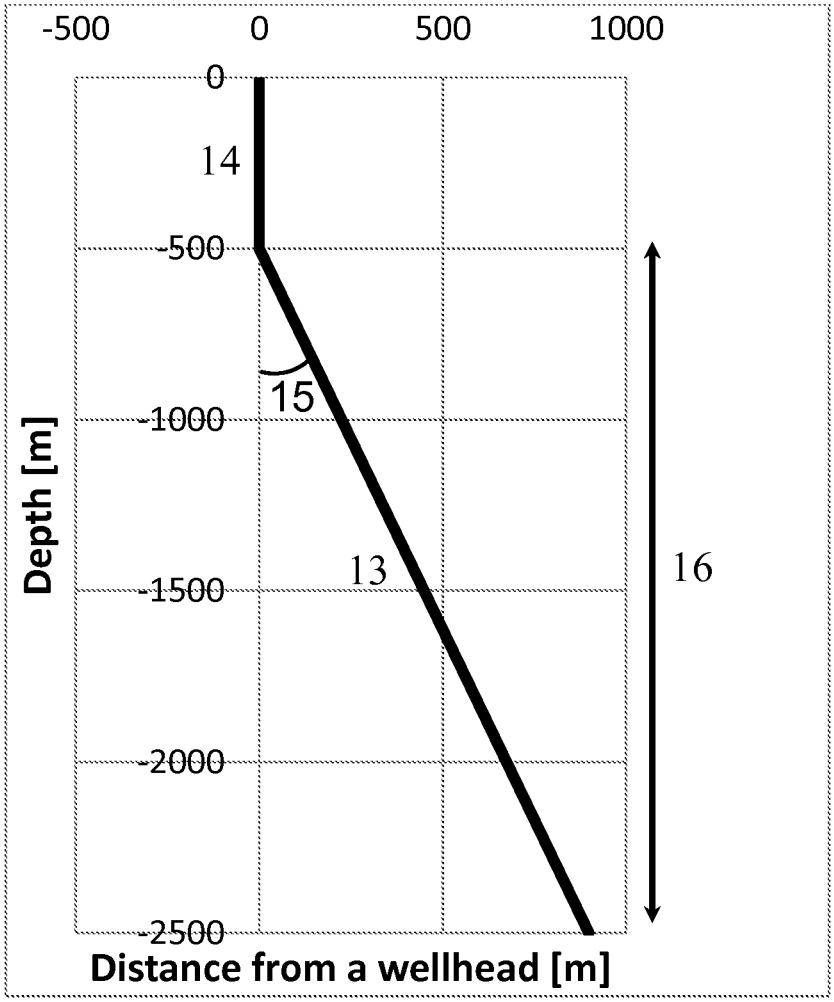
FIG. 3 shows the geometry used in the calculation example.

As a particular example, let us consider a wellbore configuration shown in FIG. 3, which is characterized by the following parameters: length of an inclined section $l_1$=2127.04 m (13 in FIG. 3), length of a vertical section $l_2$=500 m (14 in FIG. 3), and an angle of inclination θ=20° (15 in FIG. 3). Length of a perforated interval=10 m, formation pressure $p_e$=200 bar (the reduced radius of pressure $r_e$=500 m), and formation permeability k=50 mD. In this example, value of skin factor is an unknown value. Fluid density in the flow ρ=1000 kg/m$^3$, and viscosity μ=1. Assume that during running into the wellbore a string touches a liquid for the first time at an inflection point at which bottomhole pressure equals the value of hydrostatic pressure, $\rho g\ _1 = p_e$. Proceeding from this equation, we see that the height of fluid column in the wellbore at start of the operation was $_1$=2000 m (16 in FIG. 3).

Figure 4:
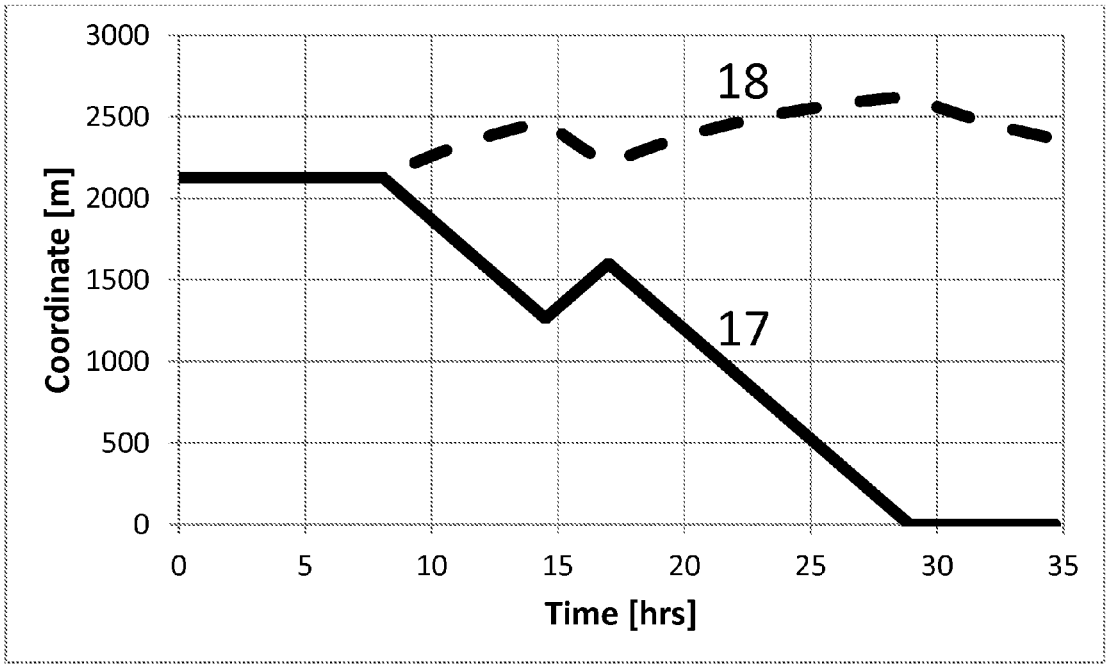
FIG. 4 shows a position of a liquid level in an annular space outside a pipe string and a position of drill pipes with a formation (reservoir) testing arrangement along the wellbore as of the time of action.

The tripping operation in this case consists of two periods of running the drill string into the wellbore and a short period of pulling the string out of the wellbore between the above-said running periods, till the end of moving the string. Average velocity was adjusted in order the value of $Z_{DST}$ calculated with the use of Equation (5) to equal zero when the string stops its movement (the lower tool achieves the terminal measured depth along the wellbore, curve 17 in FIG. 4). As a result of such adjustment, we obtain the absolute value of $v_{DST}$=0.03735 m/sec (see FIG. 4).

Figure 5:
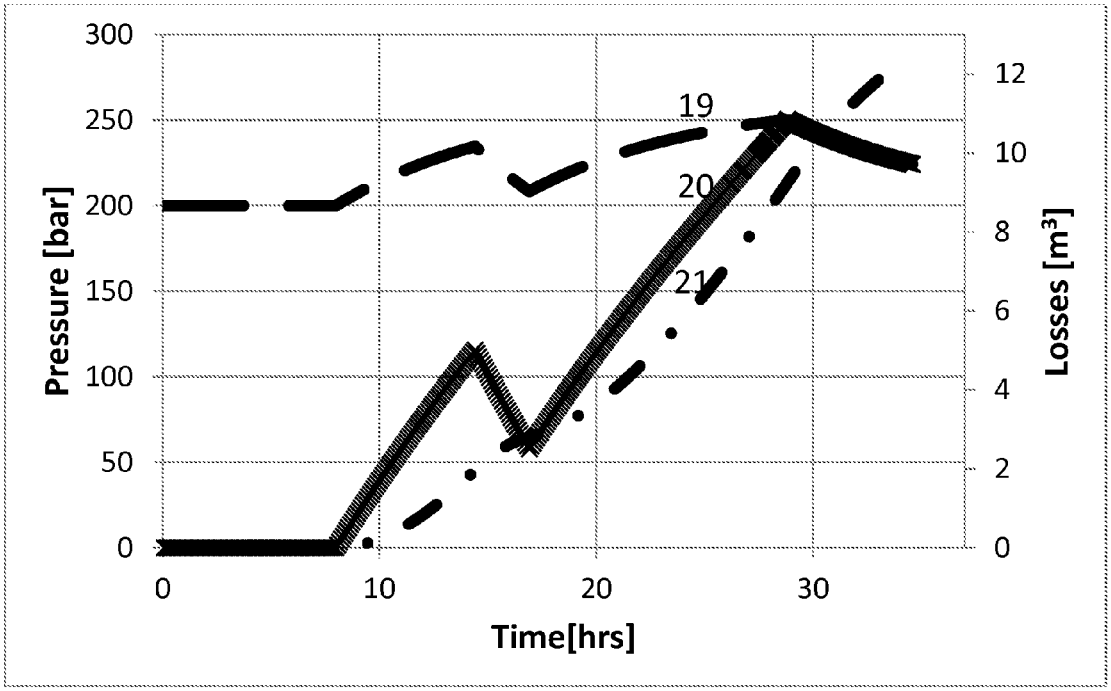
FIG. 5 shows the determined flowing bottomhole pressure and the total fluid loss volume.

After the value of $V_{DST}$ has been selected for the preset parameters, it is necessary to make sure that the value of $\max(z_{an}) = l_1 + l_2$, as of the moment of end of tripping operations (curve 18 in FIG. 4) indicates that the fluid level in the annulus have risen to the height corresponding to the reading of correct hydrostatic pressure on the pressure gauge. This automatically equates the calculated value of hydrostatic pressure with the estimated value on the pressure gauge that is calculated with the use of Equation (7). A good match is obtained for the skin factor value s=60 (see FIG. 5 where curve 19 denotes flowing bottomhole pressure, curve 20 denotes pressure on the gauge obtained with the use of Equation (7) and curve 21 denotes the total outflow into the reservoir). This figure also shows total losses $\int Q_{loss}dt$.

The present method can be applied for cases with more complex geometrical characteristics as well.

The invention claimed is:

1. A method for determining parameters of a bottomhole and a near-bottomhole zone in a wellbore drilled in a reservoir, the method comprising:

measuring pressure and temperature while moving a pipe string in the wellbore;

calculating a flowing bottomhole pressure based on the measured pressure and temperature, and calculating dynamics of fluid uptake by the reservoir based on the calculated flowing bottomhole pressure.

2. The method of claim 1 wherein the pressure and the temperature are measured by at least one pressure and temperature gauge installed along the pipe string.

3. The method of claim 2 wherein the pressure and the temperature are measured by two pressure and temperature gauges, one of which is installed above a packer and the other below the packer.

4. The method of claim 2 wherein the at least one pressure and temperature gauge is installed in the pipe string so at the end of running the pipe string to a required depth in the wellbore the at least one pressure and temperature gauge is disposed adjacent to the reservoir.

5. The method of claim 1 wherein the pipe string is equipped with additional tools.

6. The method of claim 1 wherein the pressure and the temperature are measured in the process of running the pipe string into the wellbore.

7. The method of claim 6 wherein the pressure and the temperature are measured prior to perforating the interval.

8. The method of claim 1 wherein the pressure and the temperature are measured in the process of pulling the pipe string out of the wellbore.

9. The method of claim 8 wherein the pressure and the temperature are measured after perforating the interval.

10. The method of claim 1 wherein the pressure and the temperature are measured both in the process of running the pipe string in the wellbore and in the process of pulling the pipe string out of the wellbore.

11. The method of claim 1 wherein a fluid inflow at the bottomhole zone, a fluid outflow at the bottomhole zone, or both are calculated.

12. The method of claim 1 wherein a skin factor, a permeability, or a reservoir thickness is calculated.

* * * * *